US009325122B1

(12) United States Patent
Goyal

(10) Patent No.: US 9,325,122 B1
(45) Date of Patent: Apr. 26, 2016

(54) IN-LINE FUSE HOLDER WITH REPLACEABLE FUSE

(71) Applicant: Rahul Natwar Goyal, Peachtree City, GA (US)

(72) Inventor: Rahul Natwar Goyal, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/567,898

(22) Filed: Dec. 11, 2014

(51) Int. Cl.
*H01R 13/68* (2011.01)
*H01R 13/688* (2011.01)
*H01R 43/20* (2006.01)

(52) U.S. Cl.
CPC ..... *H01R 13/688* (2013.01); *H01R 43/20* (2013.01)

(58) Field of Classification Search
CPC .. H01R 13/684; H01R 13/688; H01R 13/692; H01R 33/95; H01H 85/2035; H01H 85/545; H01H 85/547; H01H 9/102
USPC ..... 439/620.26, 620.27–620.34, 76.1, 76.2, 439/830, 949
See application file for complete search history.

(56) References Cited

U.S. PATENT DOCUMENTS 2,700,085 A * 1/1955 Breisch ..... H01H 85/201 337/201
3,356,806 A * 12/1967 Urani ..... H01H 85/201 337/192
3,465,280 A * 9/1969 Paganelli ..... H01H 85/20 340/638
3,551,869 A 12/1970 Robinson
3,778,741 A 12/1973 Schmidt, Jr.
3,843,050 A 10/1974 Melugin
4,060,303 A 11/1977 Wilczynski
4,333,701 A 6/1982 Schick
4,391,485 A 7/1983 Urani
4,531,806 A 7/1985 Hsieh
4,734,059 A 3/1988 Melugin
4,909,761 A 3/1990 Muguira
5,444,428 A 8/1995 Carr et al.
7,377,813 B2 5/2008 Pentell et al.
7,445,509 B2 * 11/2008 Korczynski ..... H01R 13/68 439/620.26
7,777,508 B2 8/2010 Armstrong (Continued)

FOREIGN PATENT DOCUMENTS

CN 102568970 7/2014
GB 2094077 9/1982
GB 2163612 8/1988

*Primary Examiner* — Neil Abrams
*Assistant Examiner* — Travis Chambers
(74) *Attorney, Agent, or Firm* — King & Spalding LLP

(57) ABSTRACT

A fuse assembly includes a housing comprising a first compartment and a second compartment. The fuse assembly also includes a fuse holder movable between a closed position and an open position relative to the housing. A fuse can be removed when the fuse holder is in the open position, and the fuse is inaccessible when the fuse holder is in the closed position. The fuse assembly also includes a first connector comprising a first fuse contact disposed at one end and a first wire coupler disposed at an opposite end. The first connector is slidable between an engaged position and a disengaged position within the first compartment. The connector is electrically coupled to the fuse in the engaged position and electrically decoupled in the disengaged position. The first connector locks the fuse holder in the closed position when the first connector is in the engaged position.

20 Claims, 4 Drawing Sheets

(56) References Cited

U.S. PATENT DOCUMENTS 7,988,493 B2 * 8/2011 Taniguchi ..... H01H 85/0208 439/620.33
8,098,126 B2 * 1/2012 Niedzwiecki ..... H01H 9/102 337/187
8,342,885 B2 * 1/2013 Jetton ..... H01H 85/0026 439/620.26
8,454,390 B2 6/2013 Darr et al.
2005/0128045 A1 * 6/2005 Lin ..... H01H 85/547 337/186
2012/0161919 A1 6/2012 von zur Muehlen

* cited by examiner

IN-LINE FUSE HOLDER WITH REPLACEABLE FUSE

TECHNICAL FIELD

The present disclosure relates generally to in-line fuse assemblies. Specifically, the present disclosure relates to an in-line fuse assembly which provides easy access and replacement of a fuse.

BACKGROUND

Fuses are commonly used in electronic systems to protect electronic equipment from overcurrent conditions. In many applications, fuses are stored inside fuse holders to form an inline fuse and are connected to current carrying cable. When an over-current condition occurs, the fuse is destroyed by the high current, causing an open circuit. Thus, the coupled electronic equipment is removed from the high current. Typically, when such a fuse is blown, it needs to be replaced with a new fuse to put the system back into normal operation. Currently, sealed inline fuse holders offered in the marketplace do not offer the option to replace just the fuse. Rather, the fuse holder is currently crimped to the cable or harness. As such, when the fuse blows, the entire fuse holder needs to be clipped from the harness and replaced with a new fuse holder. This is a time consuming and expensive replacement process which is prone to workmanship errors when crimped on site. Furthermore, certain existing fuse holder replacement techniques require shutting down the electrical system, such as in a photovoltaic application, so that there is no potential in the open wire left by the removed fuse holder. Otherwise, a live wire may be exposed.

SUMMARY

In an example embodiment of the present disclosure, an in-line fuse assembly includes a housing comprising a first compartment and a second compartment. The fuse assembly also includes a fuse holder configured to receive a fuse. The fuse holder is movable between a closed position and an open position relative to the housing. The fuse holder is disposed between the first compartment and the second compartment of the housing when in the closed position, and the fuse holder extends at least partially out of the housing when in the open position. The fuse assembly also includes a first connector comprising a first fuse contact disposed at one end and a first wire coupler disposed at an opposite end. The first fuse contact is disposed within the first compartment and the first wire coupler extends out of the first compartment, in which the first connector is slidable between an engaged position and a disengaged position within the first compartment. The first connector is coupled to the fuse holder in the engaged position, and the fuse holder remains in the closed position when the first fuse contact is in the engaged position.

In another example embodiment of the present disclosure, an in-line fuse assembly includes a housing comprising a first compartment and a second compartment. The fuse assembly further includes a fuse holder, which includes a fuse compartment configured to receive a fuse and a first securement component. The fuse holder is movable between a closed position and an open position relative to the housing. The fuse holder is disposed between the first compartment and the second compartment of the housing when in the closed position, and the fuse holder extends at least partially out of the housing when in the open position. The fuse assembly further includes a first connector. The fuse assembly includes a first fuse contact disposed at one end, a first wire coupler disposed at an opposite end, and a second securement component corresponding to and configured to couple to the first securement component. The first fuse contact is disposed within the first compartment and the first wire coupler extends out of the first compartment. The first connector is slidable between an engaged position and a disengaged position within the first compartment. The fuse holder is in the closed position and the second securement component is coupled to the first securement component when the first fuse contact is in the engaged position.

In another example embodiment of the present disclosure, a method of replacing a fuse in an in-line fuse holder assembly includes unlocking a securement mechanism. The securement mechanism comprises a first securement component configured to lock with a second securement component. The first securement component is disposed on a fuse holder and the second securement component is disposed on a first connector, in which a fuse is disposed in the fuse holder. The method further includes pulling the first connector from an engaged position to a disengaged position within a first compartment of a housing. The first connector comprises a first contact, and the first contact is electrically coupled to the fuse in the engaged position and separated from the fuse in the disengaged position. The method further includes moving the fuse holder from a closed position to an open position, in which the fuse is exposed in the open position and the first contact is physically blocked by the fuse holder and the housing in the open position. The method also includes removing the fuse from the fuse holder in the open position.

BRIEF DESCRIPTION OF THE DRAWINGS

For a more complete understanding of the disclosure and the advantages thereof, reference is now made to the following description, in conjunction with the accompanying figures briefly described as follows.

Figure 1:
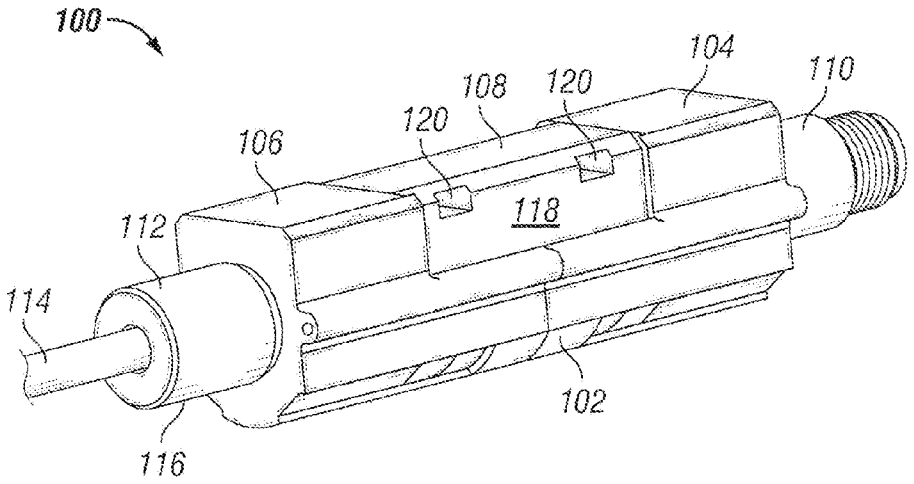
FIG. 1 illustrates a perspective view of an in-line fuse assembly with replaceable fuse in a closed position, in accordance with example embodiments of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of example embodiments of the present disclosure. Additionally, certain dimensions may be exaggerated to help visually convey such principles.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure provides an in-line fuse assembly that allows for easy handling and fuse replacement while keeping live electrical components away from the user. The in-line fuse assembly disclosed herein utilizes a locking mechanism which allows a fuse to be accessible to a user only when the fuse is completely decoupled from any current carrying components such as power cables. Conversely, the fuse is coupled to current carrying components only when the fuse is hidden and inaccessible to a user.

Figure 2:
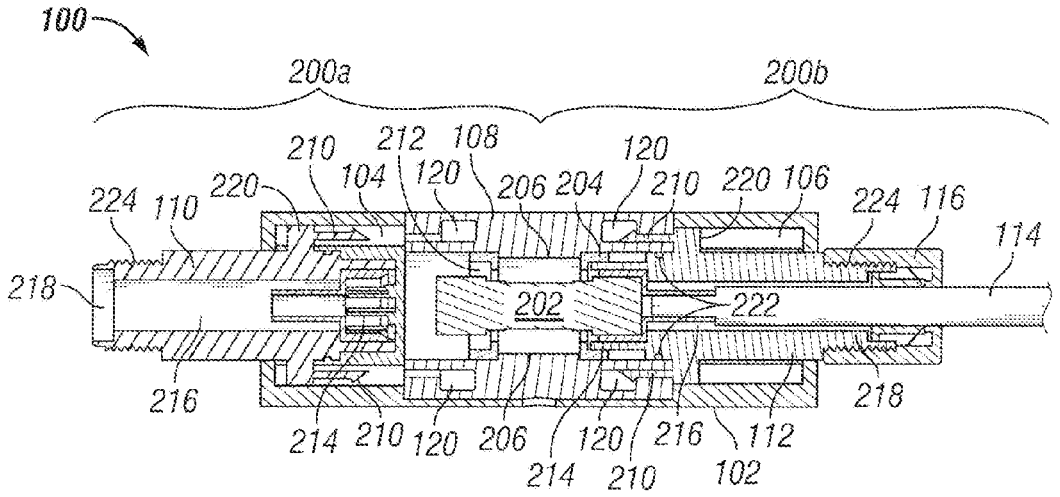
FIG. 2 illustrates a cross-sectional view of the fuse assembly, in accordance with example embodiments of the present disclosure.

Turning now to the figures, FIG. 1 illustrates a perspective view of an in-line fuse assembly with replaceable fuse 100 (hereinafter fuse assembly 100) in a closed position, in accordance with example embodiments of the present disclosure. FIG. 2 illustrates a cross-sectional view of the fuse assembly 100 in accordance with example embodiments of the present disclosure. Referring to FIGS. 1 and 2, the fuse assembly 100 includes a housing 102, a fuse holder 108, a first connector 110, and a second connector 112 (hidden by cable seal 116). The housing 102 further includes a first compartment 104, a second compartment 106, and a fuse holder compartment 118 disposed between the first compartment 104 and the second compartment 106. In certain example embodiments, and as shown in FIGS. 1 and 2, the fuse holder 108 is at least partially disposed within the fuse holder compartment 118. The fuse holder compartment 118 is better shown in FIG. 5, which shows the fuse holder 108 raised substantially out of the fuse holder compartment 118.

Referring again to FIGS. 1 and 2, in certain example embodiments, the first and second compartments 104, 106 are each closed on all sides except for a side facing the fuse holder compartment 118, putting the first and second compartments 104, 106 in communication with the fuse holder compartment 118. In certain example embodiments, when the fuse holder 108 is in the closed position as shown in FIGS. 1 and 2, the first and second compartments 104, 106 are closed on all sides. In certain example embodiments, the fuse holder 108 includes a cavity 204 configured to receive a fuse 202 therein. In certain example embodiments, the cavity 204 traverses the fuse holder 108 lengthwise and is open at both ends. This allows the fuse 202 to be easily inserted or removed when the fuse holder 108 is in the open position. In certain example embodiments, when the fuse holder 108 is in the closed position, the fuse 202 is completely enclosed by the fuse holder 108 and the housing 102, and is inaccessible from outside of the fuse assembly 100. In certain example embodiments, the fuse holder 108 includes a fuse retainer 206 configured to retain the fuse therein. The fuse holder 108 also includes a holder component 212 to hold the fuse 202 in position. The fuse holder 108 also includes a plurality of securement mechanisms 120 configured to mate with corresponding securement mechanisms 210 of the first and second connectors 110, 112.

In certain example embodiments, the first connector 110 and the second connector 112 each includes a fuse contact 214, a wire channel 216, a wire entrance 218, and the corresponding securement mechanism 210 configured to mate with the securement mechanism 120 of the fuse holder 108. In certain example embodiments, the fuse contacts 214 of the first and second connectors 110, 112 are disposed within the first and second compartments 104, 106, respectively. In certain example embodiments, the wire entrance 218 of the first and second connectors 110, 112 extend out of the first and second compartments 104, 106, respectively. The wire channels 216 are configured to receive an electrical wire or cable therein, where the wire or cable is electrically coupled to the fuse contacts 214. In certain example embodiments, the first and second connectors 110, 112 are slidable within the first and second compartments, respectively, between an engaged position and a disengaged position. A left side portion 200*a* of the fuse assembly 100 illustrates the first connector 110 in a disengaged position and without being coupled to a cable. A right side portion 200*b* of the fuse assembly 100 illustrates the second connector 112 in an engaged position and coupled to a cable 114. Referring to the right side portion 200*b*, when the second connector 112 is engaged, the fuse contact 214 is pushed toward the fuse 202 and is electrically coupled to the fuse 202 held in the fuse holder 108.

In certain example embodiments, the fuse contact 214 includes a plurality of contact features configured to fit around one end of the fuse 202 and maintain electrical contact with the fuse 202. The fuse contact 214 may be fabricated from any conductive material such as copper. When the second connector 106 is in the engaged position, the corresponding securement mechanisms 210 are coupled to the securement mechanisms 120 of the fuse holder 108. In certain example embodiments, and as illustrated, the securement mechanisms 120 and corresponding securement mechanism 210 comprise a snap fit coupling mechanism in which one or more hook tabs 210 are inserted into one or more corresponding recesses 120, thereby retaining the hook tabs 210 therein, as shown in the right side portion 200*b*. In certain example embodiments, the securement mechanisms 120, 210 can comprise any other securement, coupling, or locking mechanism which holds the connector 112 and the fuse holder 108 together.

In certain example embodiments, the securement mechanisms 120, 210 can be coupled together only when the fuse holder 108 is in the closed position. Accordingly, the fuse holder 108 is prevented from being moved to an open position when the securement mechanisms 120, 210 are mated. Thus, the mating of the securement mechanisms 120, 210 effectively "lock" the fuse holder 108 into the closed position. When both the first and second connectors 110, 112 are engaged and coupled to the fuse 202, current can flow through the fuse contacts 214 via the fuse. In certain example embodiments, a cable 114 is disposed within the wire channel 216 and sealed by the cable seal 116, which holds and seals the cable 114 in place with respect to the connector 112. In certain example embodiments, the cable seal 116 is coupled to a wire coupler 224 portion of the connector 112 opposite the fuse contact 214. In certain example embodiments, the connector 112 also includes a seal 222 which seals the connector 112 against the fuse holder 108, isolating the fuse contact 214 and fuse 202 from any external debris or water.

In certain example embodiments, the connectors 110, 112 can be disengaged by unlocking or separating the securement mechanisms 120, 210. In the illustrated example embodiment, the hook tabs 210 can be disengaged from the recesses 120 by pushing the hook tabs 210 inward from the outside of the fuse holder 108. In certain example embodiments, the securement mechanism 120, 210 can be separated by pulling the connectors 110, 112 away from the fuse holder 108 with a certain amount of force. Referring now to the left side portion 200*a* of the fuse assembly 100, which shows the first connector 110 in the disengaged position, when the connector 110 is in the disengaged position, the fuse contact 214 is physically detached and electrically decoupled from the fuse 202. In certain example embodiments, the first connector 110 include a flange 220 which prevents the first connector 110 from being pulled out of the first compartment 104. Thus, the fuse contact 214 is retained within the first compartment 104. When the first connector 110 is in the disengaged position, the fuse holder 108 is released from the securement mechanism 210 of the first connector 110. In certain example embodiments, when the fuse holder 108 is released from the securement mechanisms 210 of both the first connector 110 and the second connector 112, the fuse holder 108 is able to be moved into an open position, as this indicates that the fuse contacts 214 are also electrically decoupled from the fuse 202. In certain example embodiments, the first connector 110 and first compartment 104 are substantially symmetrical to the second connector 112 and second compartment 106, and any description of the first connector 110 and first compartment 104 are applicable to the second connector 112 and second compartment 106 as well, and vice versa.

Figure 3:
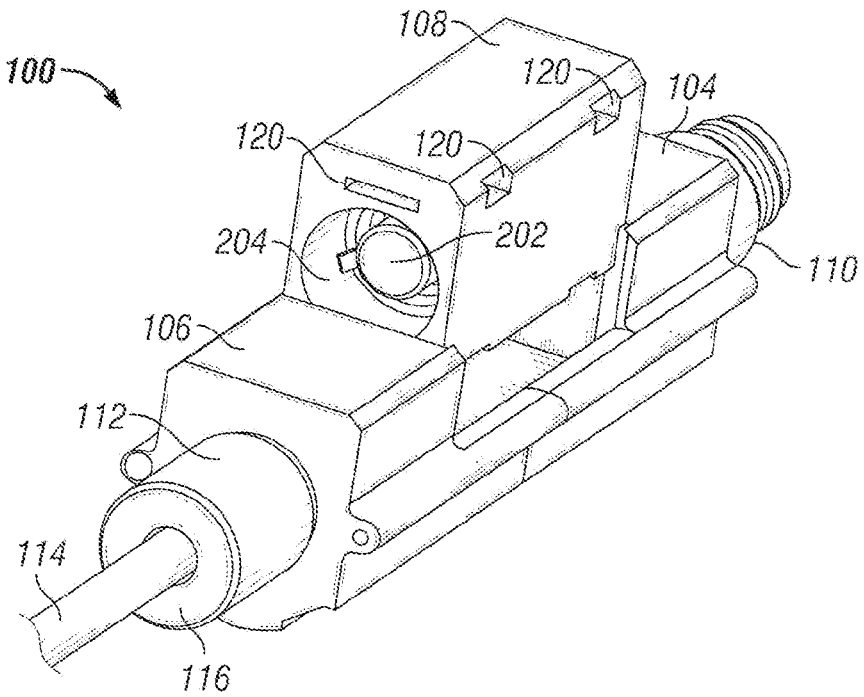
FIG. 3 illustrates a perspective view of the fuse assembly with the fuse holder in the open position, in accordance with example embodiments of the present disclosure.
Figure 4:
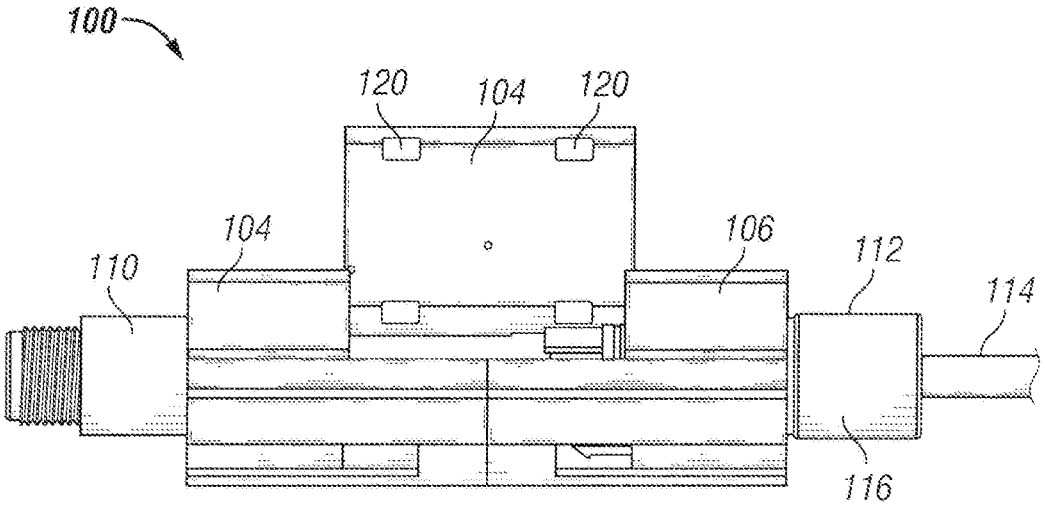
FIG. 4 illustrates a side view of the fuse assembly with the fuse holder in the open position, in accordance with example embodiments of the present disclosure.
Figure 5:
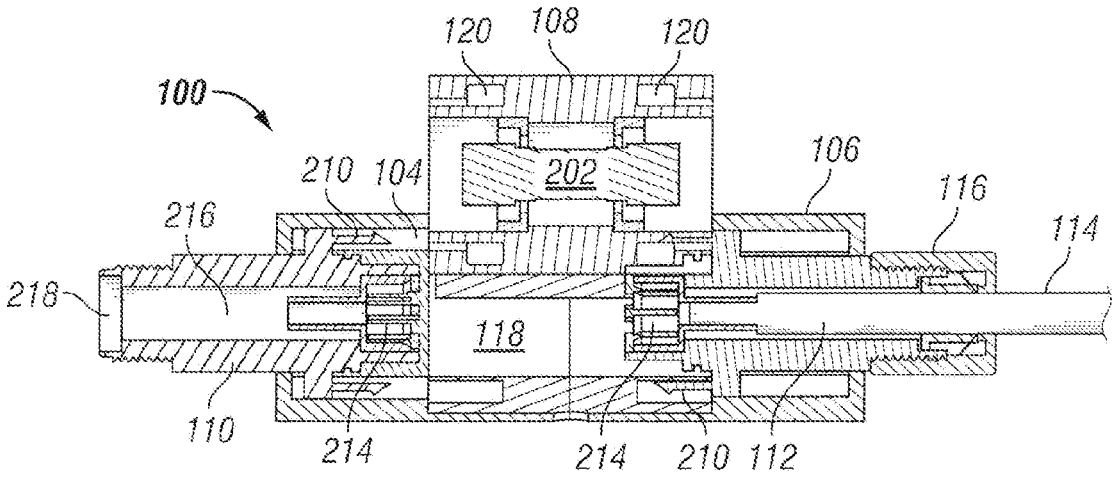
FIG. 5 illustrates a cross-sectional view of the fuse assembly with the fuse holder in the open position, in accordance with example embodiments of the present disclosure.

FIG. 3 illustrates a perspective view of the fuse assembly 100 with the fuse holder 108 in the open position, FIG. 4 illustrates a side view of the fuse assembly 100 with the fuse holder 108 in the open position, and FIG. 5 illustrates a cross-sectional view of the fuse assembly 100 with the fuse holder 108 in the open position, in accordance with example embodiments of the present disclosure. Referring to FIGS. 3, 4, and 5, in certain example embodiments, when the fuse holder 108 is in the open position, the fuse holder 108 is raised substantially out of the fuse holder compartment 118, exposing the fuse 202. When the fuse holder 108 is in the open position, the fuse 202 can be removed and replaced. The fuse contacts 214, which may be connected to a power source, are isolated within the housing and not touchable or accessible from outside the housing by a user handling the fuse 202 and the fuse assembly 100. Thus, if the fuse 202 is blown and needs to be replaced, a user can disengage the connectors 110, 112, open the fuse holder 108, and easily replace the fuse 202 without decoupling the entire fuse assembly 100 from the cable or harness. When the fuse 202 is replaced, the user can move the fuse holder 108 back into the closed position and engage the connectors 110, 112.

Figure 6:
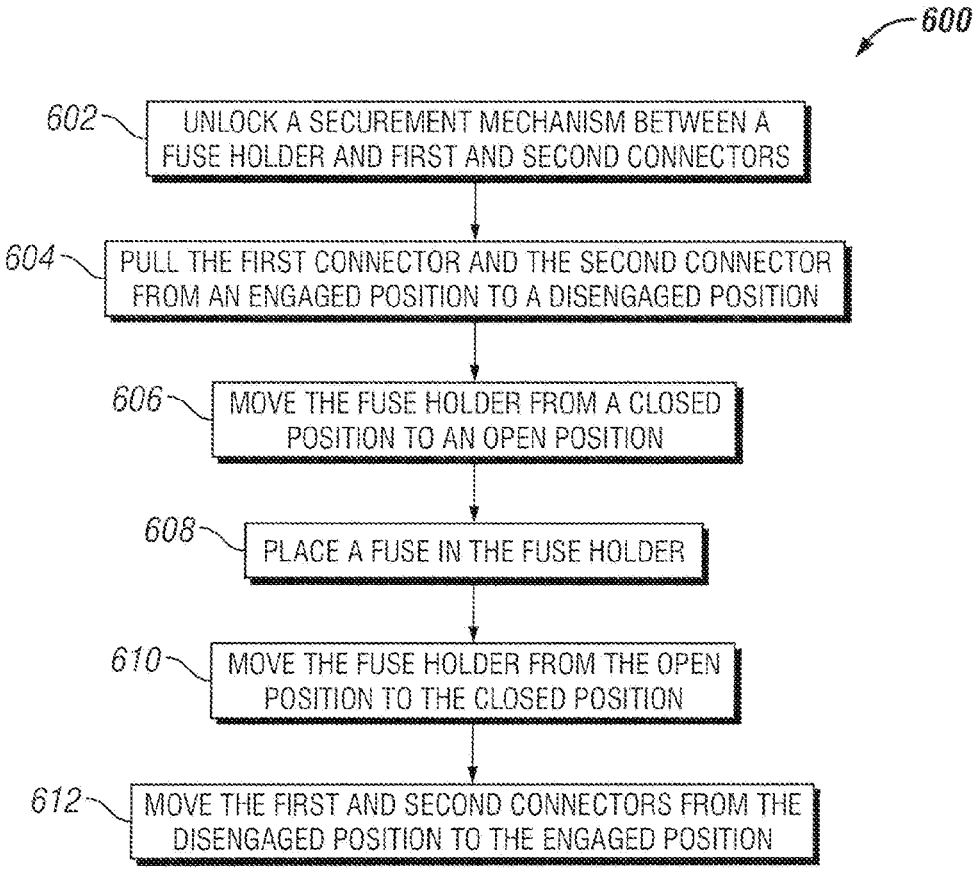
FIG. 6 illustrates a method of replacing a fuse in the fuse assembly, in accordance with example embodiments of the present disclosure.

FIG. 6 illustrates a method 600 of replacing a fuse in the fuse assembly 100, in accordance with example embodiments of the present disclosure. The method 600 includes unlocking a securement mechanism between the fuse holder 108 and the first and second connectors 110, 112 (Step 602). This separates the fuse holder 108 and the first and second connectors 110, 112. The method 600 further includes pulling the first and second connectors 110, 112 from an engaged position, in which the fuse contacts 214 are electrically coupled to the fuse 202, to a disengaged position, in which the fuse contacts 214 are retracted and decoupled from the fuse 202 (step 604). Thus, the first and second connectors 110, 112 are completely separated from the fuse 202 and fuse holder 108, this allows the fuse holder 108 to be moved. Accordingly, the method 600 includes moving the fuse holder 108 from the closed position, as shown in FIG. 1, to the open position, as shown in FIG. 3 (step 606). The method 600 also includes placing a fuse 202 into the fuse holder 108 while in the open position (step 608). In certain example embodiments, an old fuse is removed before a new fuse is put in. The method 600 further includes moving the fuse holder 108 back into the closed position (step 610), in which the fuse is no longer accessible from outside the fuse assembly 100. The method 600 then includes moving the first and second connectors 110, 112 from the disengaged position to the engaged position (step 612). When the first and second connectors 110, 112 are moved into the engaged position, the fuse contacts 214 are electrically coupled to the fuse 202 and the fuse holder 108 is locked into the closed position and generally cannot be opened until the connectors 110, 112 are disengaged.

Figure 7:
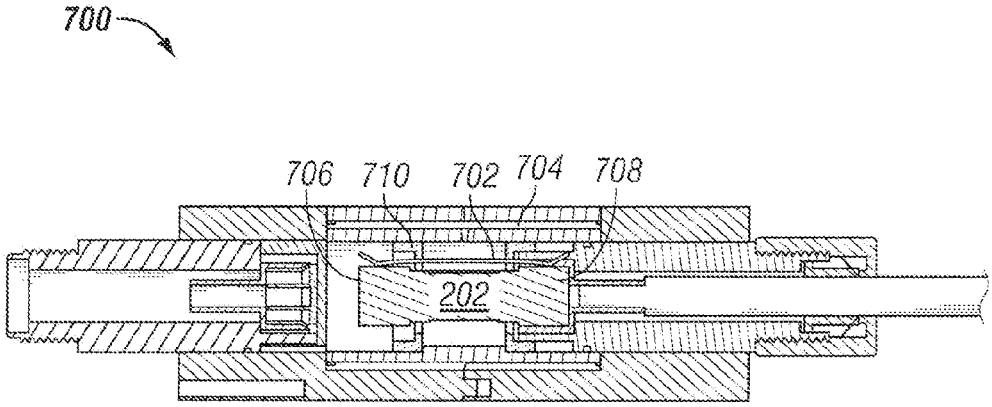
FIG. 7 illustrates a fuse assembly with a blown fuse indicator, in accordance with example embodiments of the present disclosure.

FIG. 7 illustrates a fuse assembly 700 with a blown fuse indicator 702, in accordance with example embodiments of the present disclosure. In certain example embodiments, the fuse assembly 700 is substantially similar to the fuse assembly 100 of FIGS. 1-5, with the addition of a blown fuse indicator 702 and a transparent window 704 in a fuse holder 710. In certain example embodiments, the window 704 is a closed transparent portion of the fuse holder 710, not an open orifice. In certain example embodiments, the blown fuse indicator is electrically coupled to the fuse 202 and includes a small circuit board with an LED resistor element (not shown). When the fuse 202 is healthy, the voltage drop across the two terminals 706, 708 of the fuse 202 is zero, and the LED does not light up. Alternatively, when the fuse 202 is blown, there is a potential between the two terminals 706, 708 of the fuse 202. Thus, a small trickle charge from that potential is used to energize the LED, which lights up. The lit up LED can be seen by a user through the window 704 in the fuse holder 710, indicative of a blown fuse.

Although embodiments of the present disclosure have been described herein in detail, the descriptions are by way of example. The features of the disclosure described herein are representative and, in alternative embodiments, certain features and elements may be added or omitted. Additionally, modifications to aspects of the embodiments described herein may be made by those skilled in the art without departing from the spirit and scope of the present disclosure defined in the following claims, the scope of which are to be accorded the broadest interpretation so as to encompass modifications and equivalent structures.

What is claimed is:

1. An in-line fuse assembly, comprising:

a housing comprising a first compartment and a second compartment;

a fuse holder configured to receive a fuse, the fuse holder movable between a closed position and an open position relative to the housing, wherein the fuse holder is disposed between the first compartment and the second compartment of the housing when in the closed position, and wherein the fuse holder extends at least partially out of the housing when in the open position; and a first connector comprising a first fuse contact disposed at a first end of the first connect and a first wire coupler disposed at a second end of the first connector, wherein the first fuse contact is disposed within the first compartment and the first wire coupler extends out of the first compartment, wherein the first connector is slidable between an engaged position and a disengaged position within the first compartment, wherein the first connector is coupled to the fuse holder in the engaged position, wherein the fuse holder remains in the closed position when the first fuse contact is in the engaged position.

2. The in-line fuse assembly of claim 1, wherein the first connector comprises a coupling mechanism that secures the fuse holder in the closed position when the first fuse contact is in the engaged position.

3. The in-line fuse assembly of claim 1, wherein the first fuse contact is electrically coupled to the fuse in the fuse holder when the first fuse contact is in the engaged position.

4. The in-line fuse assembly of claim 1, wherein the fuse can be removed and/or replaced when the fuse holder is in the open position.

5. The in-line fuse assembly of claim 1, wherein the first fuse contact is inaccessible when the fuse holder is in the open position.

6. The in-line fuse assembly of claim 5, wherein the housing and the fuse holder physically block the first fuse contact from a user when the fuse holder is in the open position.

7. The in-line fuse assembly of claim 1, further comprising:

a second connector comprising a second fuse contact disposed at a first end of the second connector and a second wire coupler disposed at a second end of the second connector, wherein the second fuse contact is disposed within the second compartment and the second wire coupler extends out of the second compartment, wherein the second connector is slidable between the engaged position and the disengaged position within the second compartment, wherein the second connector is coupled to the fuse holder in the engaged position, wherein the fuse holder remains in the closed position when the second fuse contact is in the engaged position.

8. The in-line fuse assembly of claim 7, wherein the fuse holder is movable into the open position when the first and second connectors are both in the disengaged position.

9. An in-line fuse assembly, comprising:

a housing comprising a first compartment and a second compartment;

a fuse holder comprising:

a fuse compartment configured to receive a fuse; and a first securement component, wherein the fuse holder is movable between a closed position and an open position relative to the housing, wherein the fuse holder is disposed between the first compartment and the second compartment of the housing when in the closed position, and wherein the fuse holder extends at least partially out of the housing when in the open position;

a first connector, comprising a first fuse contact disposed at a first end of the first connector;

a first wire coupler disposed at a second end of the first connector; and a second securement component corresponding to and configured to couple to the first securement component, wherein the first fuse contact is disposed within the first compartment and the first wire coupler extends out of the first compartment, wherein the first connector is slidable between an engaged position and a disengaged position within the first compartment, wherein the fuse holder is in the closed position and the second securement component is coupled to the first securement component when the first fuse contact is in the engaged position.

10. The in-line fuse assembly of claim 9, wherein the first fuse contact is in electrical contact with the fuse when the first fuse contact is in the engaged position.

11. The in-line fuse assembly of claim 9, wherein the fuse compartment is inaccessible from outside of the housing when the fuse holder is in the closed position.

12. The in-line fuse assembly of claim 9, further comprising:

a second connector, comprising:

a second fuse contact disposed at a first end of the second connector;

a second wire coupler disposed at a second end of the second connector; and another second securement component corresponding to and configured to couple to the first securement component, wherein the second fuse contact is disposed within the second compartment and the second wire coupler extends out of the second compartment, wherein the second connector is slidable between the engaged position and the disengaged position within the second compartment.

13. The in-line fuse assembly of claim 12, wherein the fuse holder can be put in the open position only when both the first and second connectors are in the disengaged position.

14. The in-line fuse assembly of claim 12, wherein the first and second fuse contacts are electrically decoupled from the fuse when the first and second fuse contacts are in the disengaged position.

15. A method of replacing a fuse in an in-line fuse holder assembly, comprising:

unlocking a securement mechanism, wherein the securement mechanism comprises a first securement component configured to lock with a second securement component, wherein the first securement component is disposed on a fuse holder and the second securement component is disposed on a first connector, wherein a fuse is disposed in the fuse holder;

pulling the first connector from an engaged position to a disengaged position within a first compartment of a housing, wherein the first connector comprises a first contact, the first contact electrically coupled to the fuse in the engaged position and separated from the fuse in the disengaged position;

moving the fuse holder from a closed position to an open position, wherein the fuse is exposed in the open position and the first contact is physically blocked by the fuse holder and the housing in the open position making the first contact inaccessible from outside the housing; and removing the fuse from the fuse holder.

16. The method of claim 15, further comprising:

pulling a second connector from the engaged position to the disengaged position within a second compartment of a housing, wherein the second connector comprises a second contact, the second contact electrically coupled to the fuse in the engaged position and separated from the fuse in the disengaged position.

17. The method of claim 15, wherein the securement comprises a hook tab and corresponding recess.

18. The method of claim of claim 15, wherein the fuse holder is locked in the closed position when the first connector is in the engaged position.

19. The method of claim 15, further comprising:

placing a new fuse in the fuse holder;

moving the fuse holder from the open position to the closed position, wherein the fuse is inaccessible from outside the housing in the closed position and the fuse holder is in line with the first connector in the closed position; and moving the first connector from the disengaged position to the engaged position, wherein the first contact electrically couples to the new fuse in the engaged position and the first securement component couples to the second securement component in the engaged position.

20. The method of claim 19, wherein the fuse holder is prevented from moving into the open position when the first securement component is coupled to the second securement component.

* * * * *